US007648430B2

(12) United States Patent
Gagnon

(10) Patent No.: US 7,648,430 B2
(45) Date of Patent: Jan. 19, 2010

(54) SPORTS VISION TRAINING DEVICE

(76) Inventor: Paul R. Gagnon, 45 Bunker Hill Rd., Glastonbury, CT (US) 06033

( * ) Notice: Subject to any disclaimer, the term of this patent is extended or adjusted under 35 U.S.C. 154(b) by 944 days.

(21) Appl. No.: 10/720,948

(22) Filed: Nov. 24, 2003

(65) Prior Publication Data

US 2005/0113190 A1 May 26, 2005

(51) Int. Cl.
*A63B 69/00* (2006.01)

(52) U.S. Cl. ..... 473/422; 473/450; 473/458; 428/914

(58) Field of Classification Search ..... 473/59, 473/450, 458, 464, 422, 210; 2/15; 206/440; 128/858; 156/230; 427/258, 282, 155, 147; 351/45, 41, 46, 156; 428/913, 914, 195.1
See application file for complete search history.

(56) References Cited

U.S. PATENT DOCUMENTS 4,719,909 A 1/1988 Micchia et al.
4,951,658 A * 8/1990 Morgan et al. ..... 602/74
5,050,982 A 9/1991 Meissner
5,488,438 A 1/1996 Cochran
5,521,653 A 5/1996 Anderson
5,913,849 A * 6/1999 Sundstrom et al. ..... 604/291
5,939,142 A 8/1999 Comiskey et al.
D441,081 S 4/2001 Mueller
6,320,094 B1 * 11/2001 Arnold et al. ..... 602/54
6,350,338 B1 2/2002 Comiskey et al.

FOREIGN PATENT DOCUMENTS

WO WO 9632979 A1 * 10/1996

* cited by examiner

*Primary Examiner*—Mitra Aryanpour
(74) *Attorney, Agent, or Firm*—Bachman & LaPointe, P.C.

(57) ABSTRACT

A sports vision training device is formed from a piece of material having a thickness sufficient to interfere with an individual's ability to look down at a sporting object. The piece of material has an adhesive coating or layer for positioning the material on an individual's cheek, preferably beneath an individual's eye, so that the piece of material interferes with the individual's ability to look down at the sporting object. The sports vision training device has a thickness sufficient to direct the individual's vision toward the field of play and up and toward at least one player on the field of play, and in some cases permitting intermittent and/or momentary glances at the sports object being controlled by the individual.

16 Claims, 2 Drawing Sheets

SPORTS VISION TRAINING DEVICE

BACKGROUND OF THE INVENTION

1. Field of the Invention

The present invention relates to a sports vision training device for directing an individual's field of vision up, ideally from the point equal to or greater than 90° relative to the individual's vertical field of vision, and toward the field of play and players on the field of play and for restricting, in some cases completely, the individual's field of vision with regard to a sports object being controlled by the individual such as a ball, puck: etc.

2. Prior Art

When training individuals to play such sports as basketball, soccer and hockey, it is important to train them to look up and ahead toward the field of play and toward players on the field of play and not to look at a sports object, such as a basketball, hockey puck or a soccer ball, being controlled by the individual. One item which has been tried to accomplish this task are training glasses having a restricted field of vision. U.S. Pat. No. 5,521,653 to Anderson; U.S. Pat. No. 5,488,438 to Cochran; and U.S. Pat. No. 5,050,982 to Meissner exemplify such training glasses. The glasses however are difficult to use because of their weight and size and are uncomfortable in many instances. They also have a tendency to slip as moisture and sweat appear on a user's face. As a result, it is often necessary to use restraining devices to keep them in place.

Often the performance of athletes is impacted by the glare of the sun or glare created by arena or stadium lights. It is known in the prior art to apply light absorbing devices beneath an athlete's eyes. Such devices are exemplified by U.S. Pat. No. 4,719,909 to Micchia et al.; U.S. Pat. No. 5,939,142 to Comiskey et al.; and U.S. Pat. No. 6,350,338 to Comiskey et al. and U.S. Design Pat. No. D441,081 to Mueller. The light absorbing devices are very thin and are not designed to interfere with a user's vision in any way. In other words, they lack the ability to restrict a user's field of vision. Hence, someone wearing these devices is fully capable of seeing a ball such as a basketball, soccer ball or a hockey puck being controlled by that person. These light absorbing devices have no value as a training aid.

Thus, there remains a need for a lightweight training device which can be used to direct an individual's field of vision up and toward the field of play and players and to restrict the individual's field of vision of a ball, puck, etc.

SUMMARY OF THE INVENTION

Accordingly, it is an object of the present invention to provide a sports vision training device which directs an individual's field of vision up, ideally above 90° relative to the individual's vertical field of vision, and toward the field of play and the players on it.

It is also an object of the present invention to provide a sports vision training device which restricts, in some cases completely, the individual's field of vision of a sports object such as a ball, puck, etc. being controlled by a user.

It is yet another object of the present invention to provide a sports vision training device which is lightweight, easy to use and, if so desired by the individual, a single-use disposable item.

The foregoing objects are attained by the sports vision training device of the present invention.

In accordance with the present invention, a sports vision training device broadly comprises a member formed from a piece of material having a thickness sufficient to interfere with an individual's ability to look down at a sporting object being controlled by the individual. The piece of material has an adhesive layer for positioning the training device on an individual's cheek and beneath an individual's eye so that the piece of material interferes with the individual's ability to look down at the sporting object. The sports vision training device has a thickness sufficient to direct the individual's vision up and toward the field of play and toward at least one player on the field of play. In some cases, the device also enables the individual to have intermittent and/or partial vision of the sports object, but is of sufficient thickness to direct the individual's vision up and toward the field of play.

A system for training an individual to look up and forward while playing a sport and encouraging the individual to not look down at an object being controlled by the individual is provided in accordance with the present invention. The system broadly comprises a pair of potentially disposable view restricting members with each member being adhesively applied to one of the cheeks of the individual under each eye, and each member having a thickness sufficient to interfere with the individual's vision if the individual attempts to look down and sufficient to encourage the individual to look in a forward direction up and towards a field of play and at least one player on the field of play.

A method for training an individual playing a sport broadly comprises the steps of providing at least one member having an adhesive layer and a thickness sufficient to interfere with the individual's field of vision, and positioning the at least one member on at least one cheek under each eye of the individual so as to interfere with the individual's ability to look downwardly at a sports object being controlled by the individual and to restrict the individual's field of vision to looking forward up and towards a field of play and at least one person on the field of play.

Other details of the sports vision training device of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
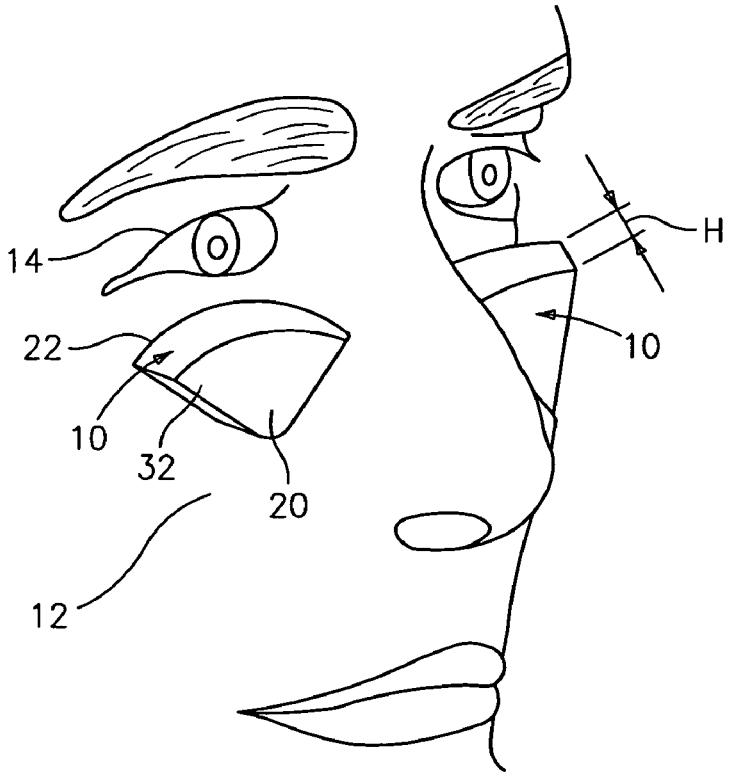
FIG. 1 is a side view from the left of an individual wearing the sports vision training device.
Figure 2:
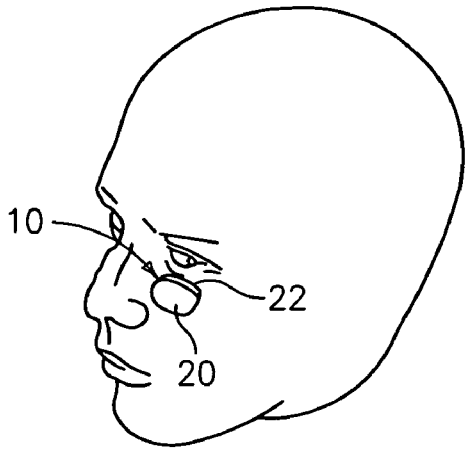
FIG. 2 is a side view from the top right of an individual wearing the sports vision training device.
Figure 3:
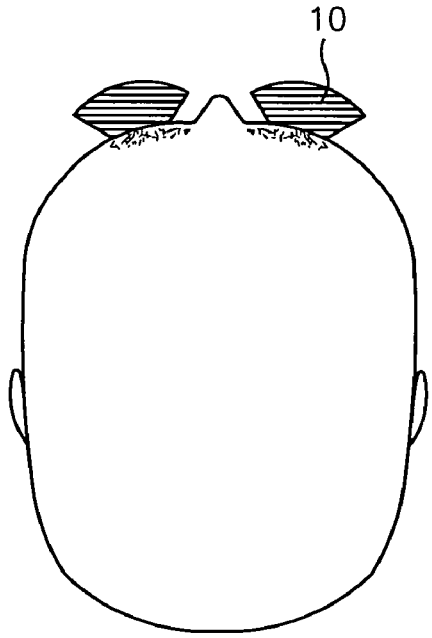
FIG. 3 is a top view of an individual wearing the sports vision training device.
Figure 4A:
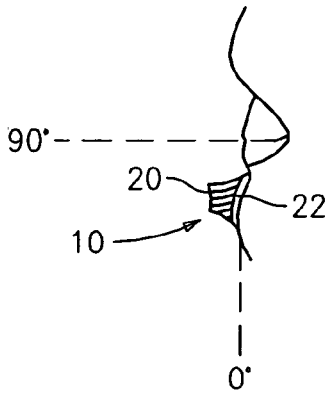
FIGS. 4A and 4B illustrate an alternative embodiment of a sports vision training device in accordance with the present invention.
Figure 4B:
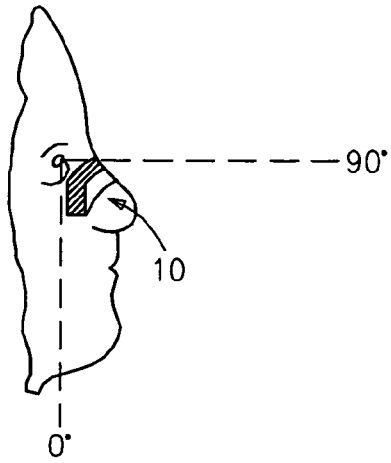

Referring now to the drawings, FIGS. 1-3 show an individual wearing the sports vision training device 10 of the present invention. As can be seen from the figures, a sports vision training device 10 may be worn on each cheek 12 beneath the eye 14. While FIGS. 1-3 illustrate two training devices 10 worn by the individual, it is within the scope of the present invention for the sports training device 10 to comprise a single device which extends from the left eye to the right eye and passes over the wearer's nose as shown in FIGS. 4A and 4B.

Figure 5:
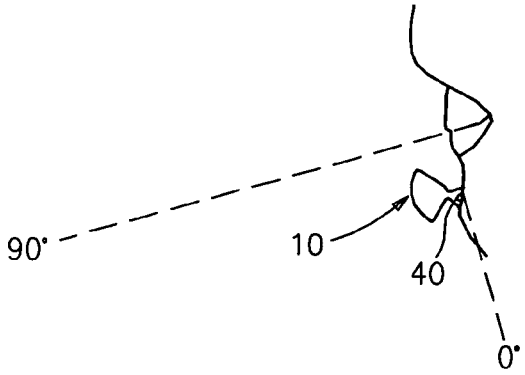
FIG. 5 illustrates a sports vision training device in accordance with the present invention having a butterfly configuration.

Referring now to FIG. 1, the device 10 is a multi-layer device. The first layer 20 consists of a pad or patch with an adhesive coating or a second layer 22 consisting of an adhesive material for securing the device 10 under the individual's eye. The device 10 may have any desired shape such as a mushroom shape or a butterfly shape (see FIG. 5) to enable intermittent or partial view of the sports object being controlled by the individual ideally at the point equal to and less than 20° relative to the individual's vertical field of vision. The device 10 may have any desired length and any desired width. Typically, the device has a length of 1.5 inches or shorter and a width of 0.5 inches or shorter.

The adhesive coating or layer 22, in a preferred embodiment, includes a hydrocolloidal material to absorb moisture, such as perspiration, and for transferring the moisture from the surface of the wearer's skin to the material forming the first layer 20. The layer 20 may be formed from any suitable material known in the art, such as an open-cell foam material, which allows the moisture to evaporate, thus enabling the device 10 to adhere to the wearer's skin for a typical sports training session and later disposal, or, potentially, for reuse at a later time.

The device 10 is provided with a height H which is sufficient to direct an individual's field of vision up and toward the field of play and players thereon and to restrict an individual's field of vision of a sports object, such as a ball or a puck, being controlled by the individual so as to encourage play with a head and eyes up orientation relative to the field of play. The height H, in a preferred embodiment, may be one quarter inch or more.

Figure 6:
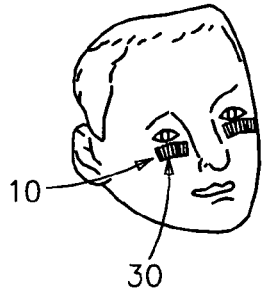
FIG. 6 illustrates a grooved sports vision training device in accordance with the present invention.

As shown in FIG. 6, the device 10 may be provided with one or more grooves 30, or with a narrow stem 40 (see FIG. 5) at the base of which is the adhesive coating or layer, to allow a limited view of the sports object being controlled by the individual. These features have particular application when used by less-skilled individuals that are training to improve their ability to control a sports object (basketball, soccer ball, hockey puck).

The sports vision training device 10 of the present invention has a number of advantages. First, it is lightweight and can be easily applied. Second, it absorbs moisture from the wearer's skin and allows it to evaporate to the environment. Third, the use of the hydrocolloidal material in the adhesive layer helps prevent rapid loss of adhesive strength. Fourth, the use of the hydrocolloidal material helps prevent skin rash or trauma to the skin upon removal of the device. Fifth, it encourages play with a desired head and eyes up orientation.

Figure 7:
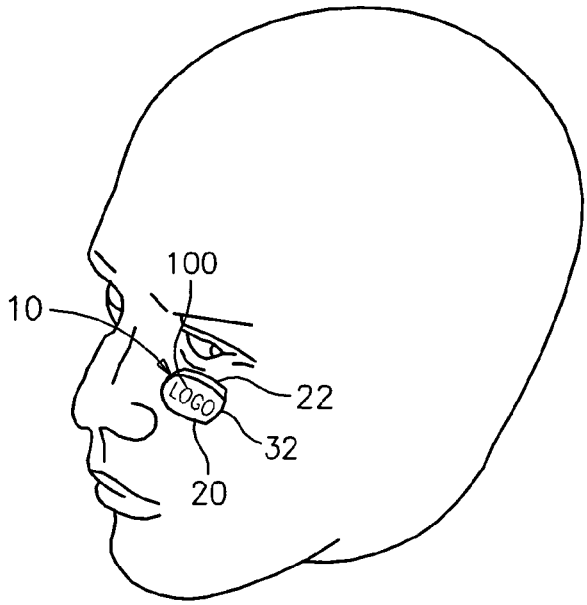
FIG. 7 illustrates a sports vision training device in accordance with the present invention having written indicia such as a logo.

If desired, as shown in FIG. 7, the exterior surface 32 of the layer 20 can be provided with written indicia 100 in the form of logos, team names, etc.

If desired, one of the devices 10 of the present invention could be worn along side of each eye to restrict the wearer's peripheral vision. Such a device may be worn when practicing certain training drills such as shooting drills so as to focus the wearer's eyes and attention on an intended target.

It is apparent that there has been provided in accordance with the present invention a sports vision training device which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A sports vision training device comprising:

a piece of material having a thickness sufficient to interfere with an individual's ability to look in a specific direction at a sporting object being controlled by the individual;

said piece of material having an adhesive coating or layer for positioning said piece of material; and said piece of material being positioned beneath an individual's eye without said piece of material covering any portion of said eye so that said piece of material interferes with said individual's ability to look at said sporting object while attempting to control said sporting object due to said thickness while said piece of material allows said individual to look forward and up without any vision obstruction, wherein said piece of material has an upper surface and said upper surface is intermittently grooved to permit momentary glances at said sports object.

2. A sports vision training device according to claim 1, wherein said piece of material has a thickness sufficient to direct the individual's vision up and toward the field of play and players on said field of play.

3. A sports vision training device according to claim 1, wherein said piece of material is formed from an open-cell foam material.

4. A sports vision training device according to claim 1, wherein said adhesive coating or layer includes means for absorbing moisture and for transferring said moisture from a surface of the individual's skin to the piece of material to allow the moisture to evaporate.

5. A sports vision training device according to claim 4, wherein said moisture absorbing and transferring means comprises a hydrocolloidal material incorporated into said adhesive layer.

6. A sports vision training device according to claim 1, wherein said piece of material has written indicia on an upper surface.

7. A sports vision training device according to claim 1, wherein said piece of material has a logo on an upper surface.

8. A sports vision training device according to claim 1, wherein said device is disposable.

9. A sports vision training device according to claim 1, wherein said thickness is at least one quarter inch.

10. A sports vision training device according to claim 1, wherein said piece of material is positioned so as to enable at least partial view of said sporting object being controlled by said individual at a point equal to 20 degrees relative to the individual's vertical field of vision.

11. A sports vision training device according to claim 1, wherein said piece of material is positioned so as to enable at least partial view of said sporting object being controlled by said individual at a point less than 20 degrees relative to the individual's vertical field of vision.

12. A system for training an individual encouraging them to look up and forward while playing a sport without looking down at an object being controlled by said individual, said system comprising:

a pair of potentially disposable view restricting members;

each said member being adhesively applied to one of the cheeks under an eye of said individual without covering any portion of said eye and without interfering with the individual's ability to see in upward and forward directions; and each said member having an upper edge positioned beneath said eye and a thickness sufficient to interfere with said individual's vision if said individual attempts to look down and sufficient to encourage said individual to look in said upward and forward directions toward a field of play and at least one player on said field of play, wherein each said member has a first layer formed from an open-cell foam material, wherein each said member has an adhesive coating or layer for holding said member to a respective cheek of said individual, said adhesive coating or layer abutting a surface of said first layer, wherein said adhesive coating or layer contains a hydrocolloidal material for absorbing moisture and for transferring said moisture from a surface of said respective cheek to the first layer for evaporation into the atmosphere, and wherein each said member has an upper surface and intermittently spaced grooves in said upper surface, or with a narrow stem at the base of which is the adhesive for allowing momentary glances downwardly at the sports object being controlled by the user.

13. A system according to claim 12, further comprising vision restriction devices attached to an individual's face along side each eye to restrict the individual's peripheral vision.

14. A system according to claim 13, wherein each said vision restriction device comprises a first layer formed from an open cell material and a second adhesive coating or layer for adhering the vision restriction device to the individual's face.

15. A system according to claim 14, wherein said adhesive coating or layer has a hydrocolloidal material incorporated therein.

16. A method for training an individual playing a sport, said method comprising the steps of:

providing at least one member having an upper edge, an adhesive coating or layer and a thickness sufficient to interfere with said individual's field of vision; and positioning said at least one member on at least one cheek under an eye of said individual in a position where said upper edge is beneath said eye and which does not cover any portion of said eye so that said thickness interferes with the individual's ability to look downwardly at a sports object being controlled by the individual and to restrict said individual's field of vision to looking forward and up towards a field of play and at least one person on said field of play.

* * * * *

UNITED STATES PATENT AND TRADEMARK OFFICE

CERTIFICATE OF CORRECTION

PATENT NO. : 7,648,430 B2
APPLICATION NO. : 10/720948
DATED : January 19, 2010
INVENTOR(S) : Paul R. Gagnon It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 943 days.

Signed and Sealed this

Twenty-eighth Day of December, 2010

David J. Kappos

David J. Kappos
*Director of the United States Patent and Trademark Office*